United States Patent [19]

Hartl

[11] Patent Number: 4,509,311

[45] Date of Patent: Apr. 9, 1985

[54] METHOD AND APPARATUS FOR LOADING AND UNLOADING PACKAGE-FORMING MACHINE

[75] Inventor: Carroll P. Hartl, Madison, Wis.

[73] Assignee: General Foods Corporation, White Plains, N.Y.

[21] Appl. No.: 305,482

[22] Filed: Sep. 25, 1981

[51] Int. Cl.[3] ..... B65B 7/06

[52] U.S. Cl. ..... 53/202; 53/373; 53/477; 53/509

[58] Field of Search ..... 53/509, 477, 202, 373

[56] References Cited

U.S. PATENT DOCUMENTS 2,413,553 12/1946 Evers ..... 271/194 X 3,195,284 7/1965 Crane ..... 53/373 X 3,517,831 6/1970 Hahn ..... 414/71 X

*Primary Examiner*—A. J. Heinz

*Attorney, Agent, or Firm*—J. T. Harcarik; T. R. Savoie; D. J. Donovan

[57] ABSTRACT

A method and apparatus are disclosed for simultaneously loading and unloading food packages into and from a package-forming machine. A pusher and puller are mounted on opposite directions, toward and away from the machine, whereby packages can be inserted into the machine at the same time packages are withdrawn. In a preferred embodiment, the pusher and puller include package gripping jaws slidably mounted for reciprocal movement. A shuttle which mounts the jaws may also include a bellcrank and latch system for controlling opening and closing of the jaws.

7 Claims, 17 Drawing Figures

METHOD AND APPARATUS FOR LOADING AND UNLOADING PACKAGE-FORMING MACHINE

The present invention relates, in general, to a method and apparatus for loading and unloading food packages into and from a package-forming machine. More particularly, the present invention relates to a method and apparatus for simultaneously inserting an unsealed food package between a pair of spaced-apart sealing portions of the package-forming machine while simultaneously withdrawing a sealed package from the machine.

Food packages, especially for sliced luncheon meat products (bologna, salami, summer sausage, etc.), are often made up of two parts—a container or tray into which the product is placed, and a cover sealed to the tray. Examples of such food packages are shown in U.S. Pat. Nos. 3,229,810 and 3,498,018.

Certain operations during the forming of food packages as described above have typically been manual operations. For example, a rigid plastic tray, loaded with stacks of luncheon meat, arrives at the operator's station, who places the cover or backing on the tray, and manually inserts the unsealed package between a pair of spaced-apart heat-sealing portions of a package-forming machine. The portions have heated surfaces so that when closed, the stacks of luncheon meat are hermetically sealed, preferably under vacuum. After the sealing is complete, the sealing portions open, and the operator removes the sealed tray and then inserts an unsealed tray into the machine. As the cost of labor continues to rise, automation is becoming increasingly desirable to improve efficiency, reduce cost and improve quality control.

Accordingly, an object of the present invention is to provide a method and apparatus for inserting unsealed food packages into a package-forming machine and withdrawing sealed packages from the machine.

Another object of the present invention is to provide a method and apparatus for automatically and simultaneously withdrawing sealed packages from the package-forming machine and inserting unsealed packages to minimize operating time.

A further object of the present invention is to provide such method and apparatus which are reliable, easy to maintain and do not damage the package of product during inserting or withdrawal from the package-forming machine.

These and other objects will become apparent from the following detailed description of this invention.

These objects are achieved in the present invention by providing a pusher and puller on opposite sides of the package-forming machine and moving the pusher and puller simultaneously in opposite directions, whereby a sealed package is simultaneously withdrawn from between the sealing portions of the machine by the puller, while an unsealed package is inserted between the sealing portions by the pusher.

In accordance with one aspect of the present invention, the pusher and puller each has a pair of gripping jaws for gripping the package, which jaws are generally slidably mounted for movement into the space between the sealing portions of the package-forming machine to engage and withdraw a sealed package while simultaneously pushing an unsealed package into the space vacated by the sealed package. Preferably, each pair of jaws is carried by a slidably-mounted shuttle, which also mounts a bellcrank and latch system which is operable to open or close the jaws at selected positions along the path of movement of the shuttle to release or engage a package as desired.

These and other aspects of the present invention are set forth more fully in the following detailed description of the attached drawings, which depict the preferred embodiment of the present invention, and of which:

Figure 5A:
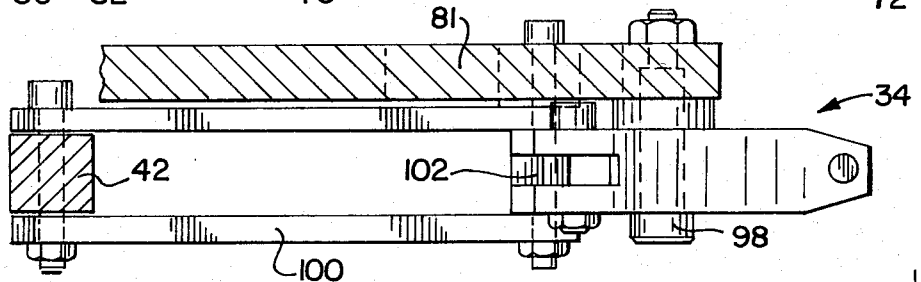
FIG. 5 is a side elevational view of a pair of gripping jaws employed in the present invention, depicted in the closed position in solid lines and in the open position in dashed lines.
Figure 5:
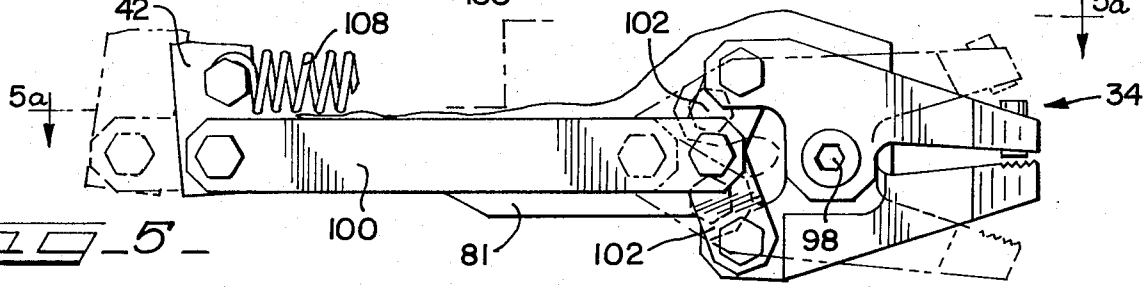

FIG. 5*a* is a top plan view, partially in section, of the gripping jaws of FIG. 5, taken along line 5*a*—5*a*.

Figure 6:
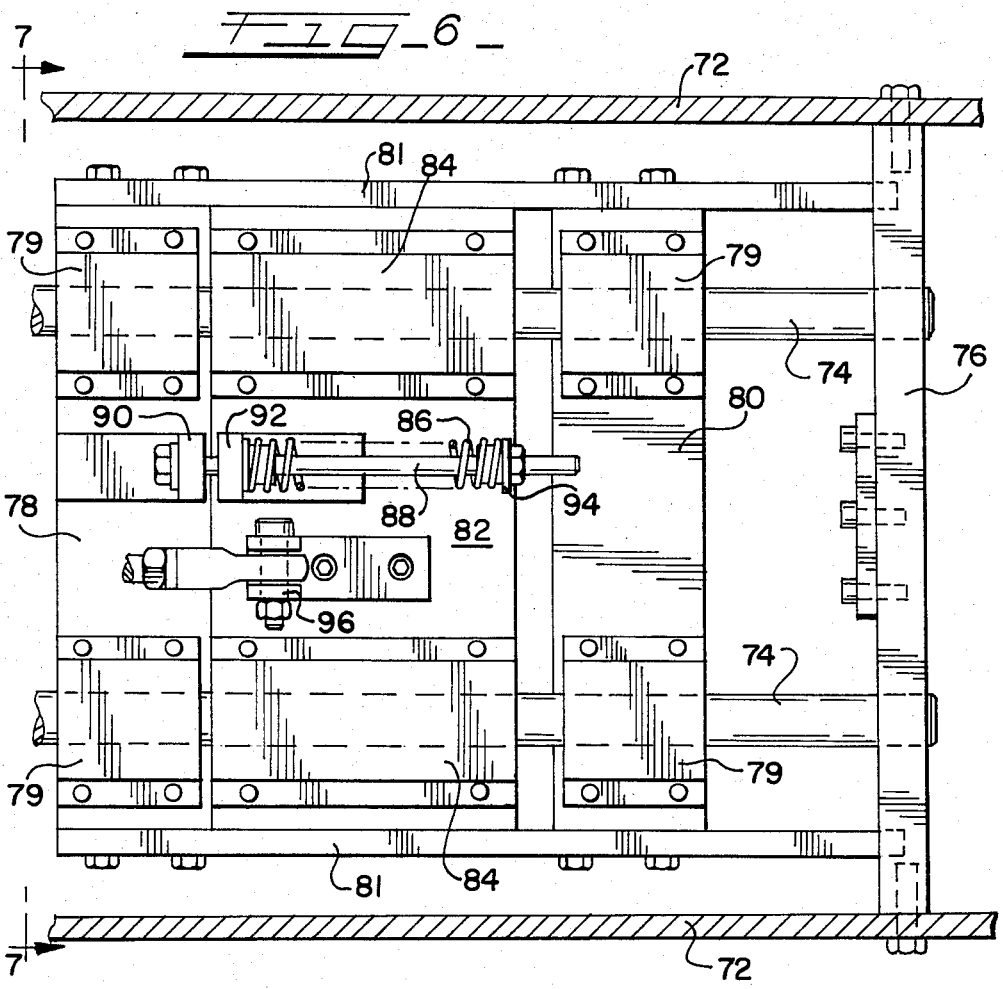

FIG. 6 is a plan view of the slidably mounted shuttle for the puller.

Figure 7:
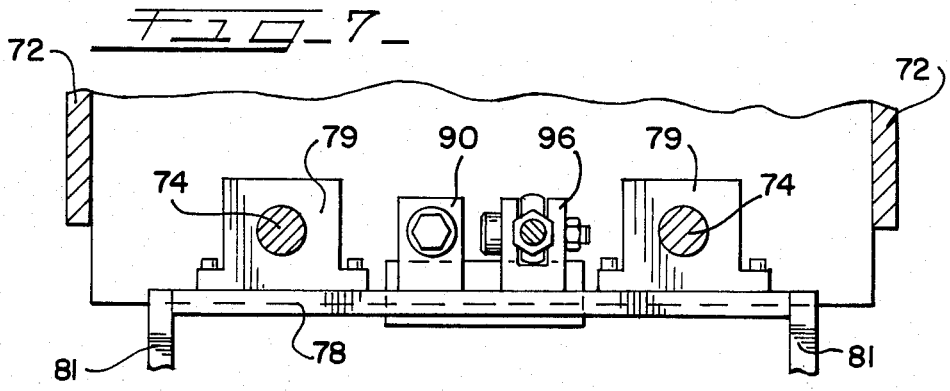

FIG. 7 is a vertical sectional view taken along line 7—7 of FIG. 6, and showing the rearward end of the shuttle.

Figure 1:
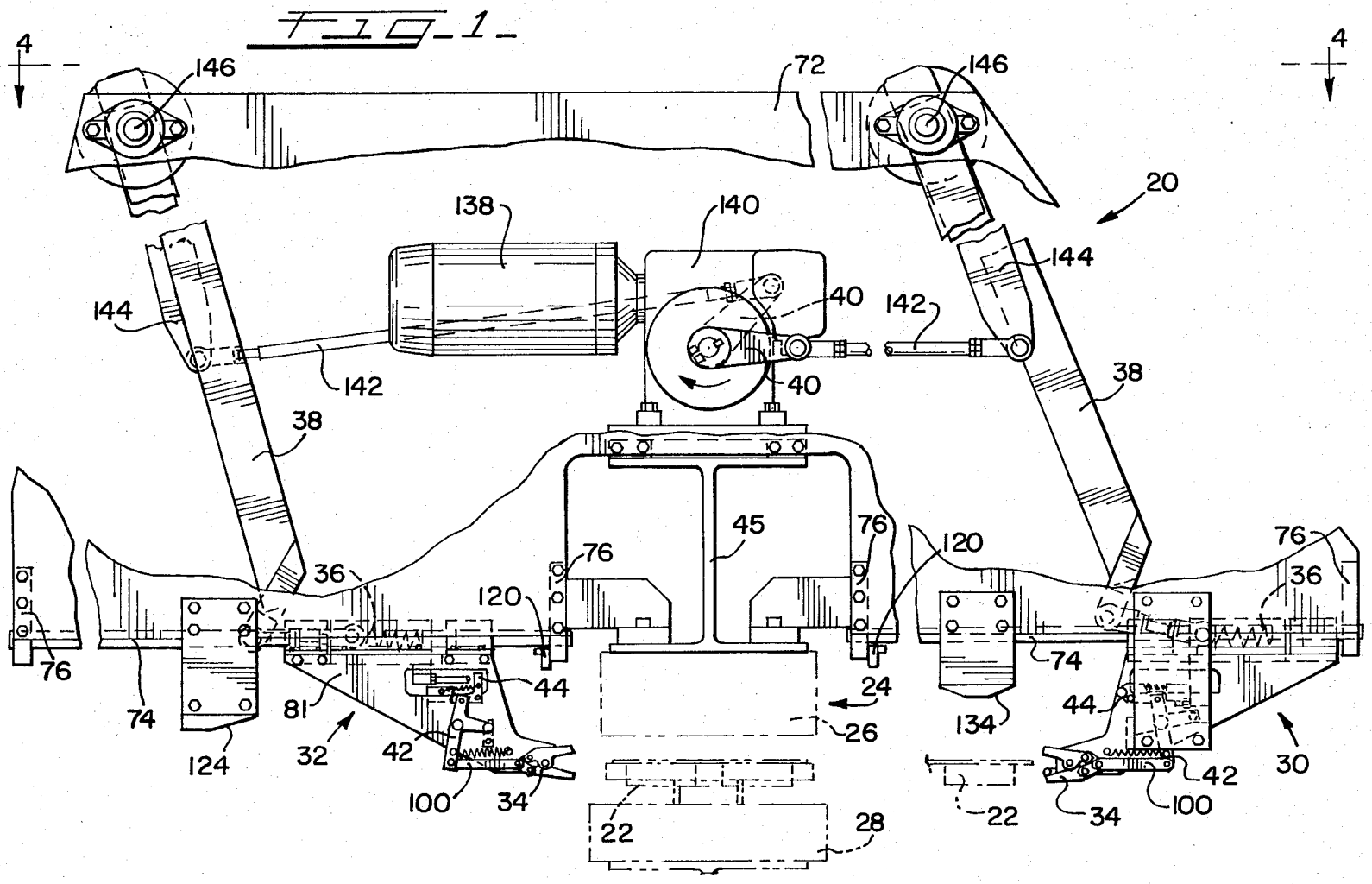
FIG. 1 is a fragmented side elevational view of an apparatus embodying the present invention, depicting the puller just prior to engagement with a sealed package for withdrawal from the package-forming machine and depicting the pusher just prior to engagement with an unsealed package for insertion into the machine.
Figure 8:
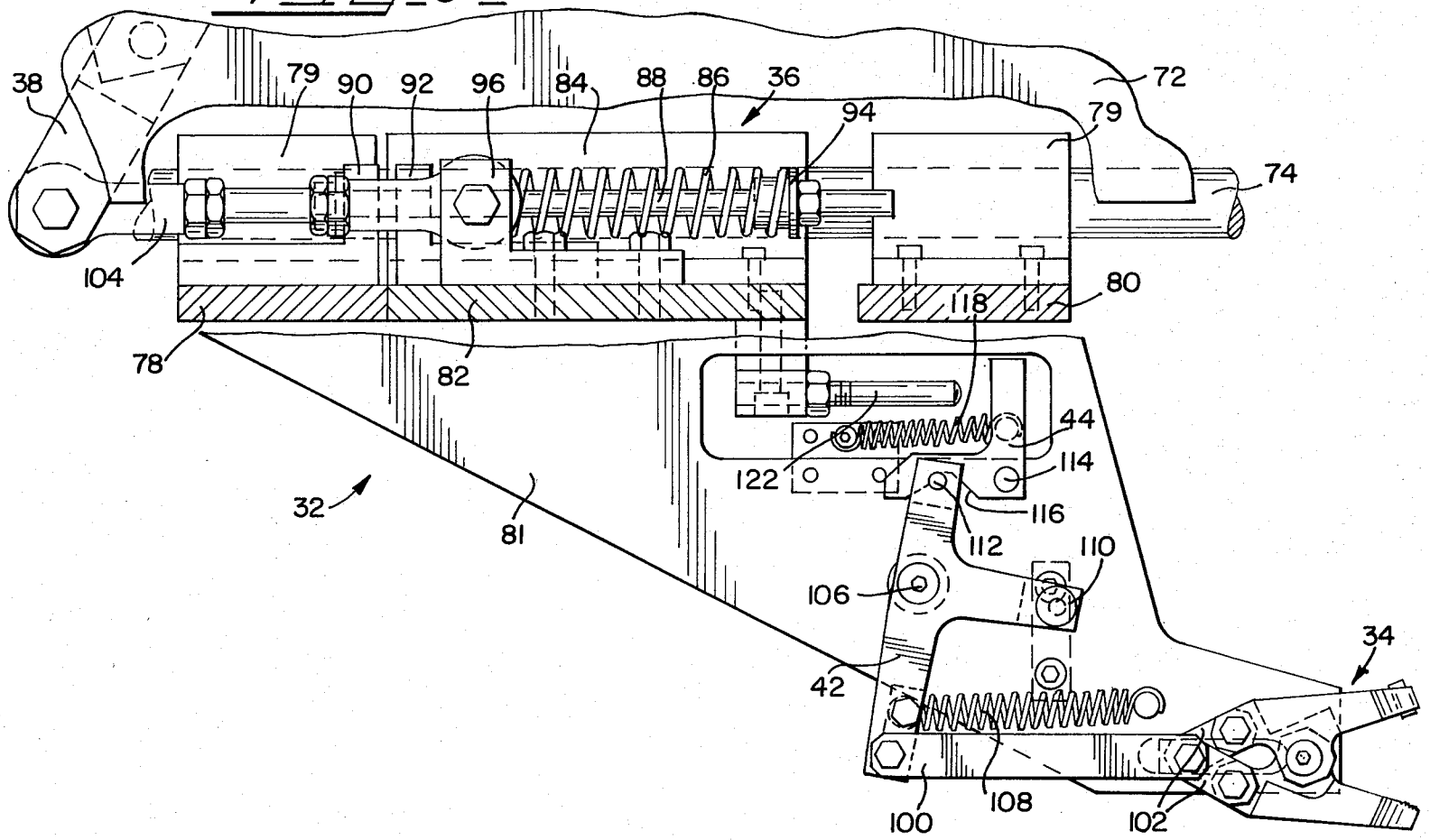

FIG. 8 is an enlarged side elevational view, partially removed, showing the puller in the position of FIG. 1, prior to engaging a sealed package.

Figure 2:
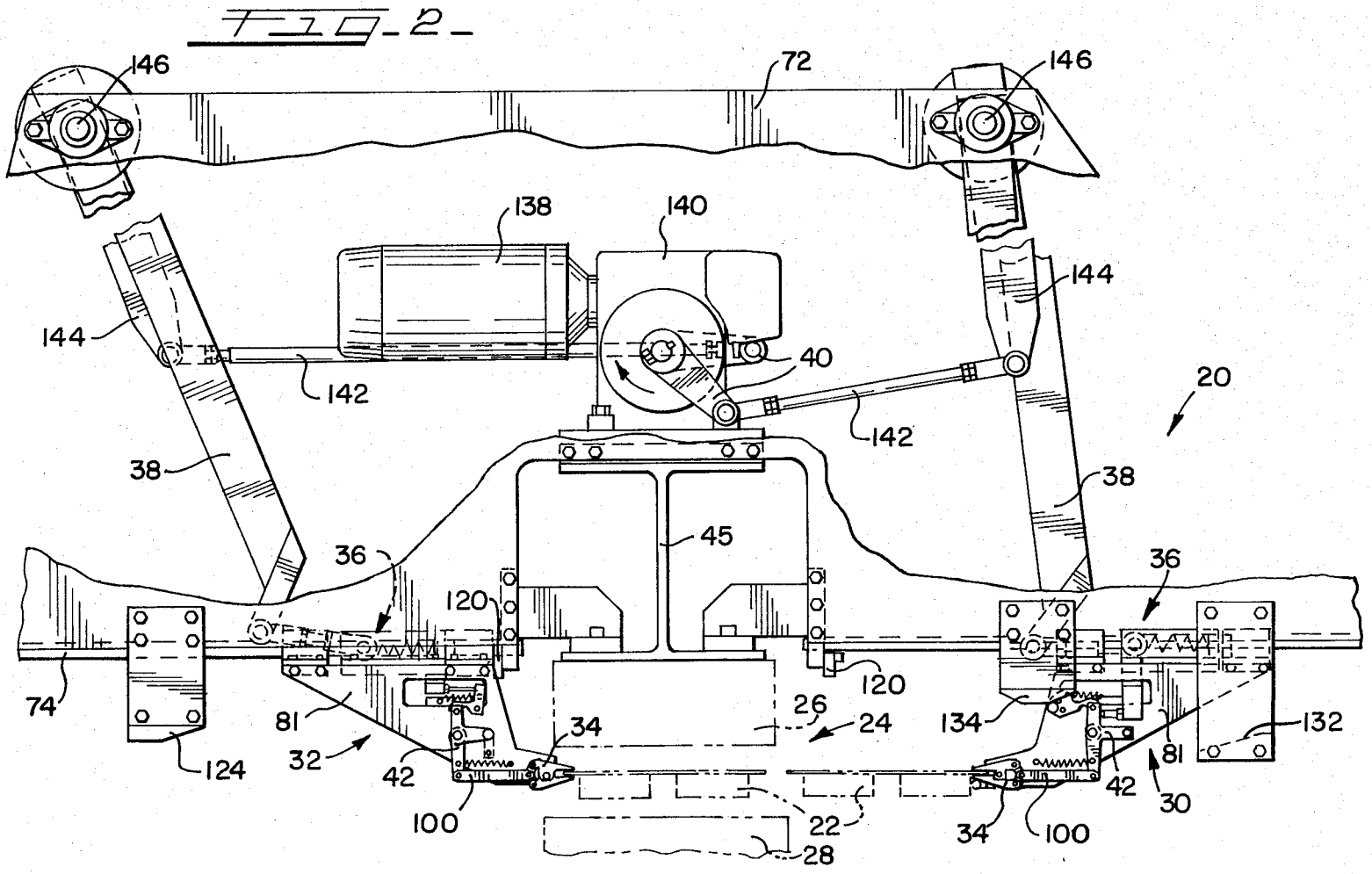
FIG. 2 is a side elevational view similar to that of FIG. 1, but depicting the pusher and puller in positions wherein the puller is engaged with a sealed package for withdrawal and the pusher is engaged with an unsealed package for insertion between the sealing members of the package-forming machine.
Figure 9:
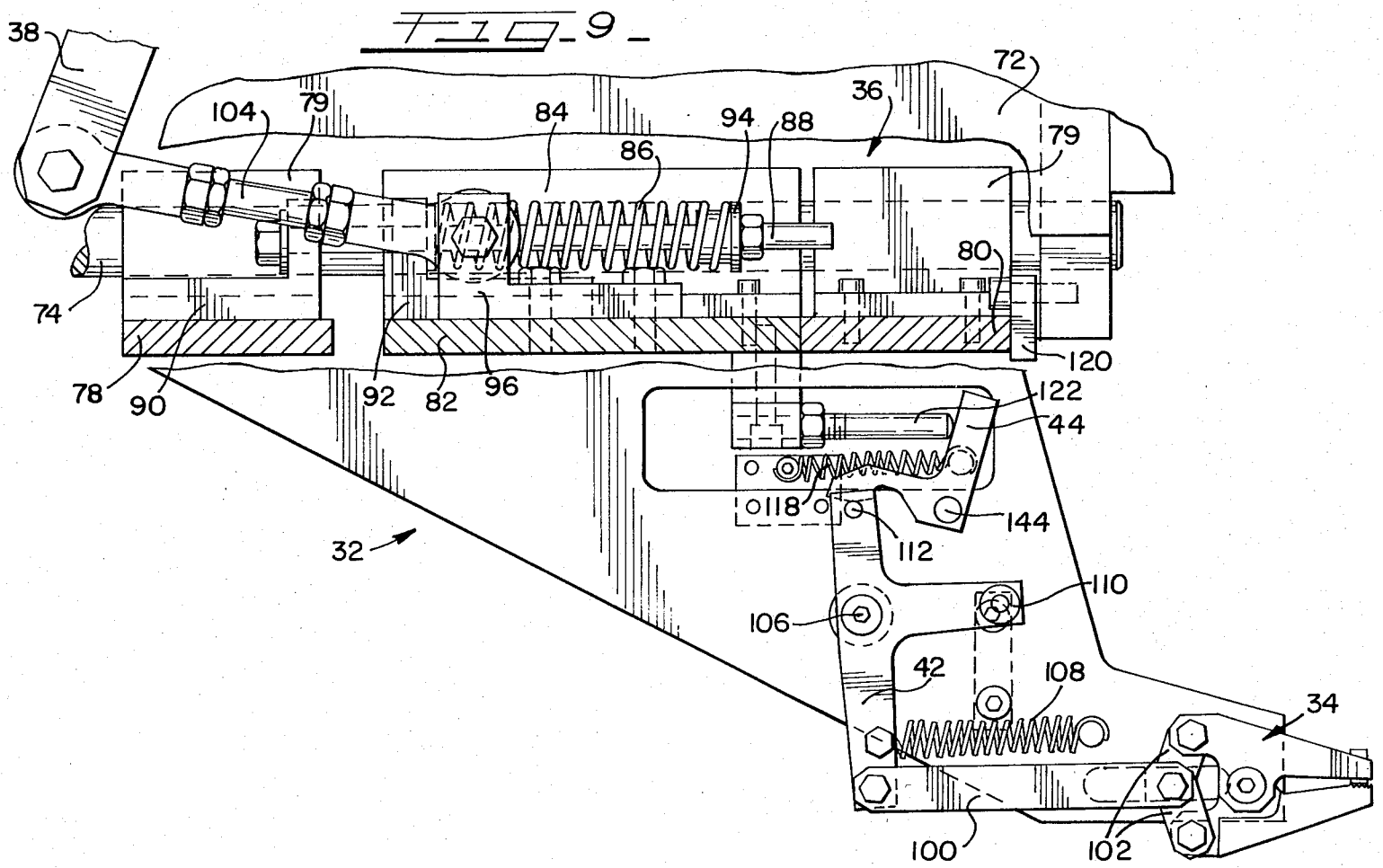

FIG. 9 is a side elevational view of the puller, like that of FIG. 8, but showing the puller in the position depicted in FIG. 2, with the jaws closed to engage a sealed package.

Figure 10:
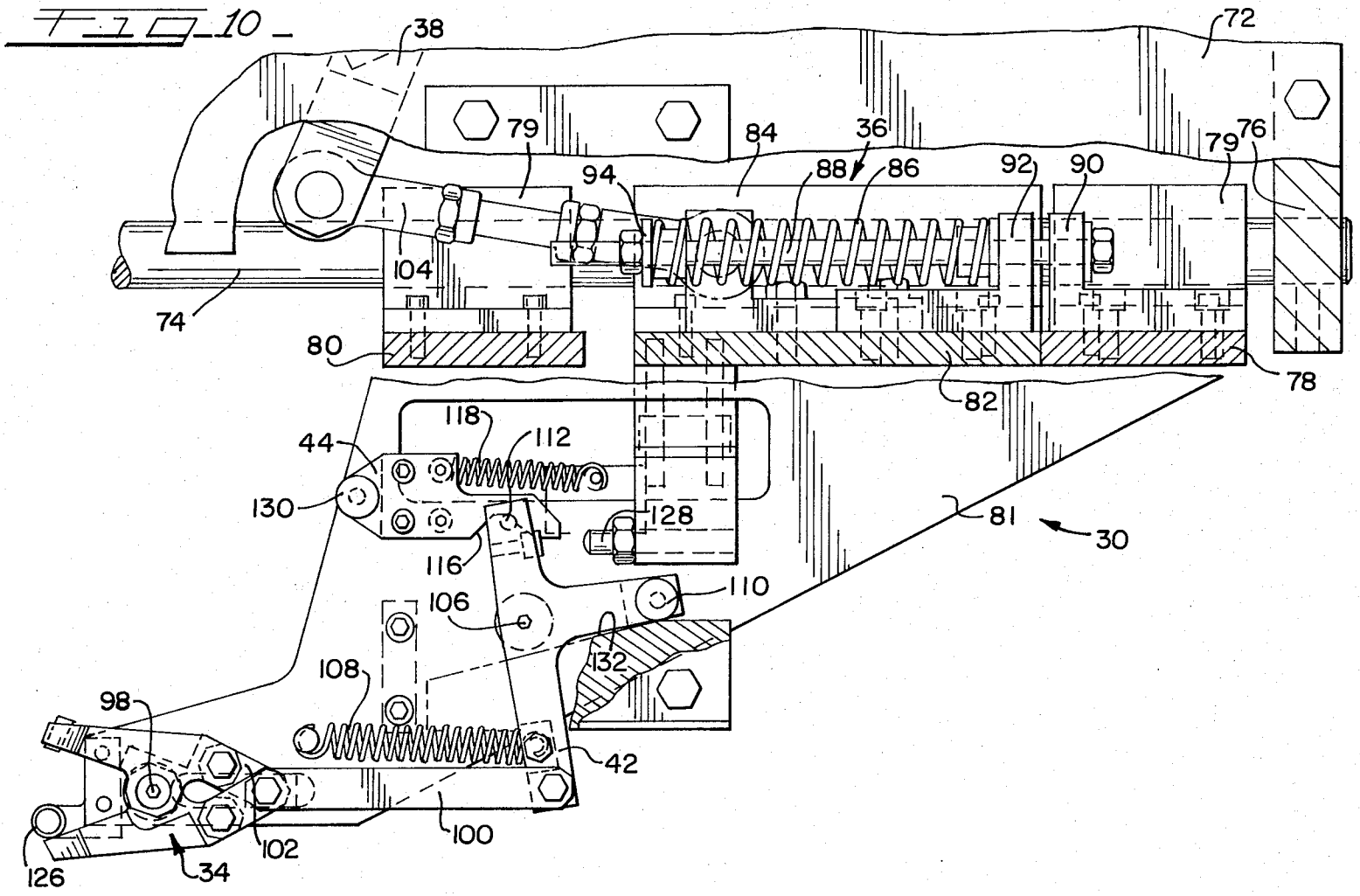

FIG. 10 is an enlarged side elevational view, partially removed and partially in section, depicting the pusher at the position shown in FIG. 1, with the jaws in an open position, prior to engaging an unsealed package.

Figure 11:
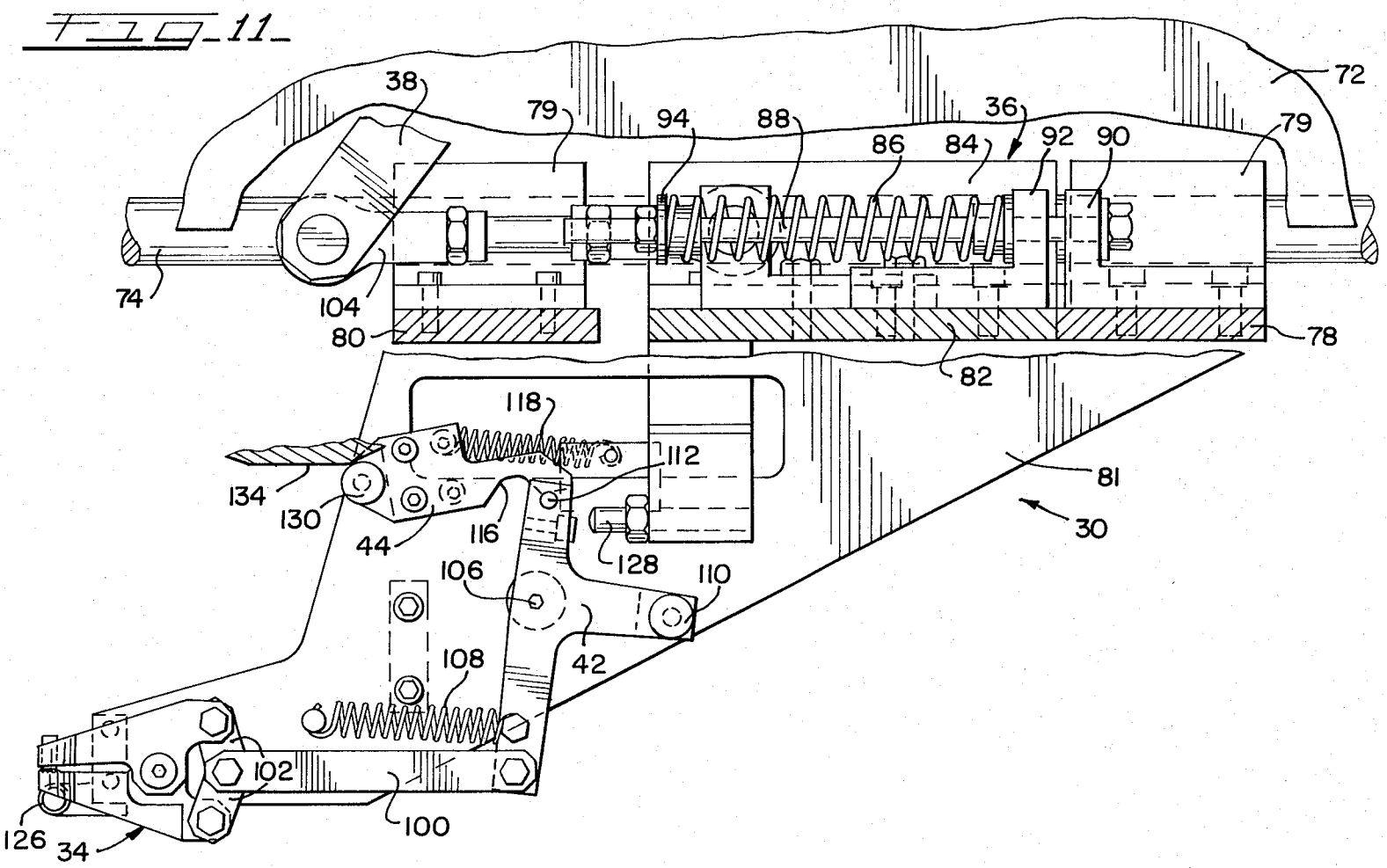

FIG. 11 is a side elevational view like that of FIG. 10, but depicting the pusher at the position shown in FIG. 2, with jaws closed to engage the marginal edge of a package to be inserted into the package-forming machine.

Figure 3:
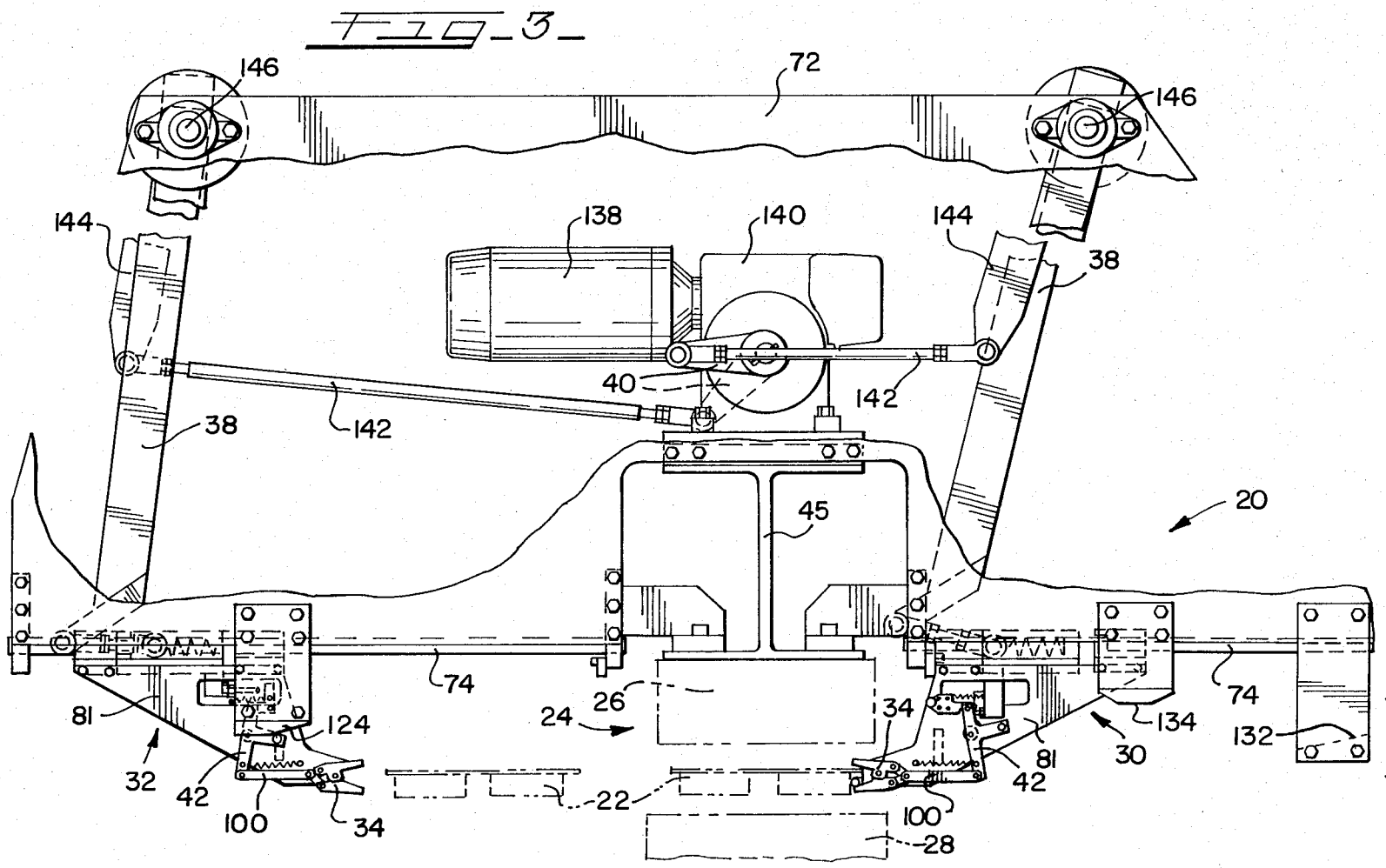
FIG. 3 is a side elevational view like that of FIGS. 1 and 2, but depicting the puller after withdrawal and release of a sealed package and the pusher after insertion and release of an unsealed package.
Figure 12:
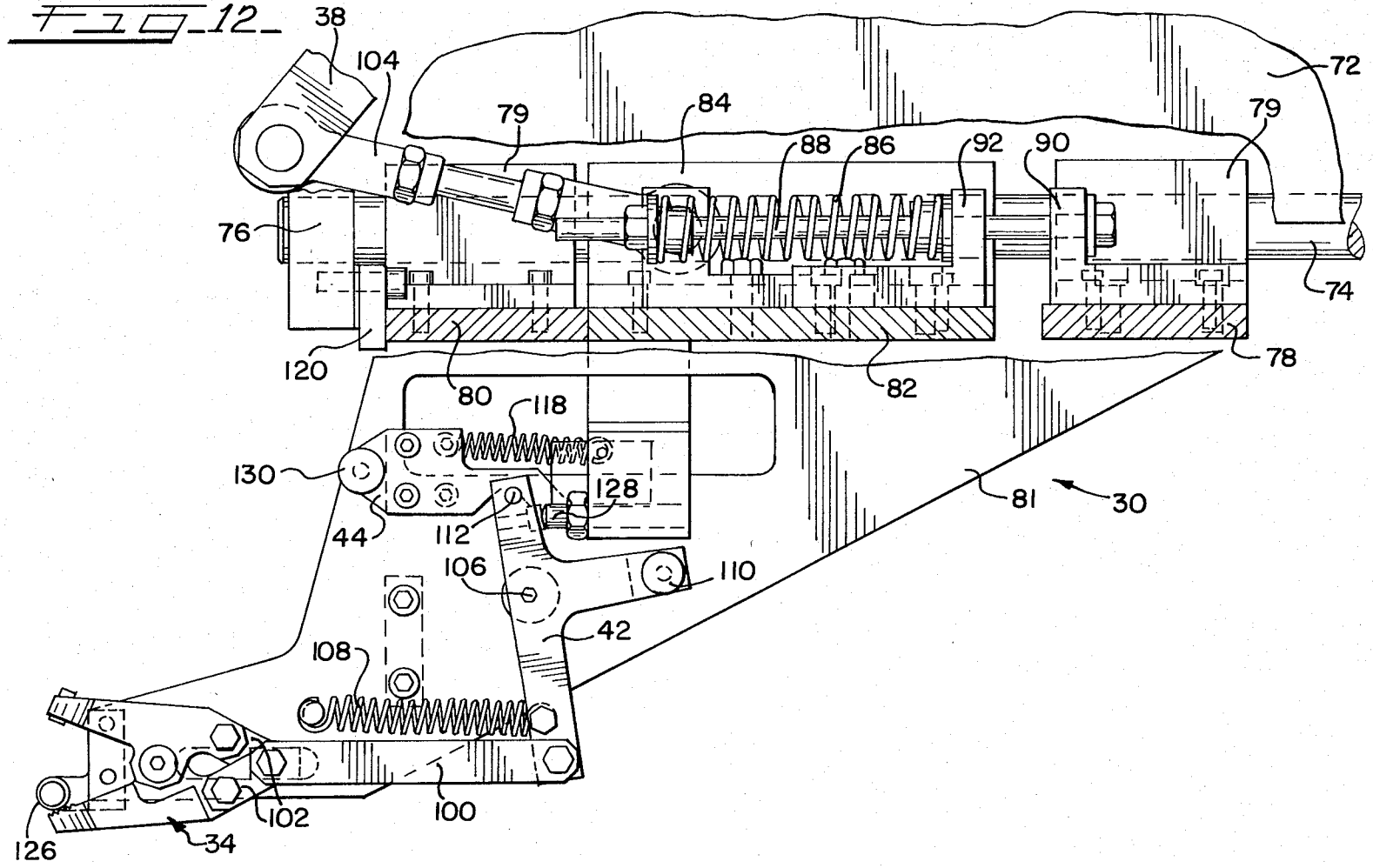

FIG. 12 is a side elevational view like that of FIGS. 10 and 11, but depicting the pusher at the position shown in FIG. 3, with the jaws being opened to release the unsealed package between the sealing portions of the package-forming machine.

Figure 13:
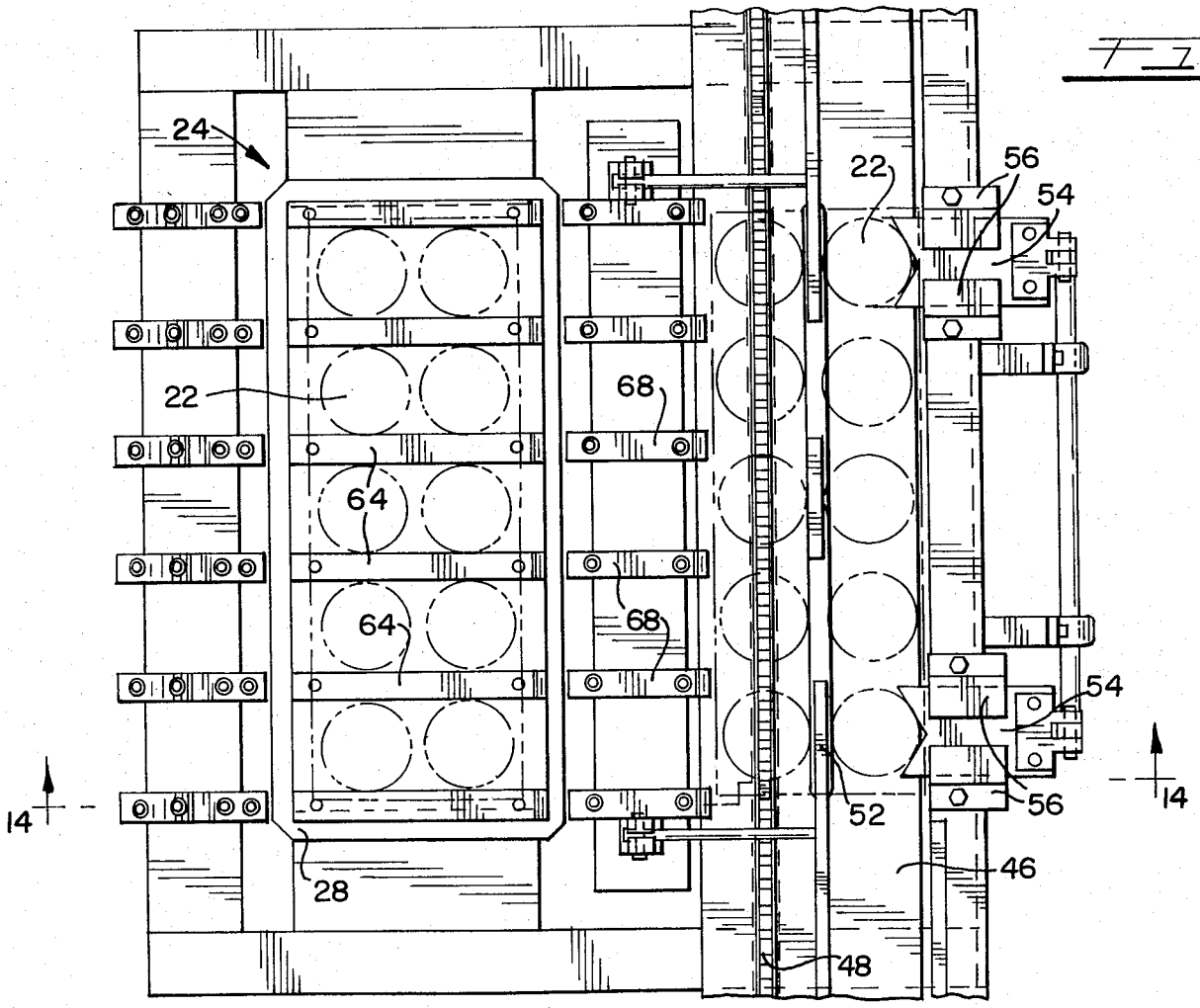

FIG. 13 is a horizontal cross-sectional view taken through the space between the sealing portions of the package-forming machine and depicting the inside surface of the lower of the sealing portions and a supply conveyor located alongside the sealing portions.

Figure 14:
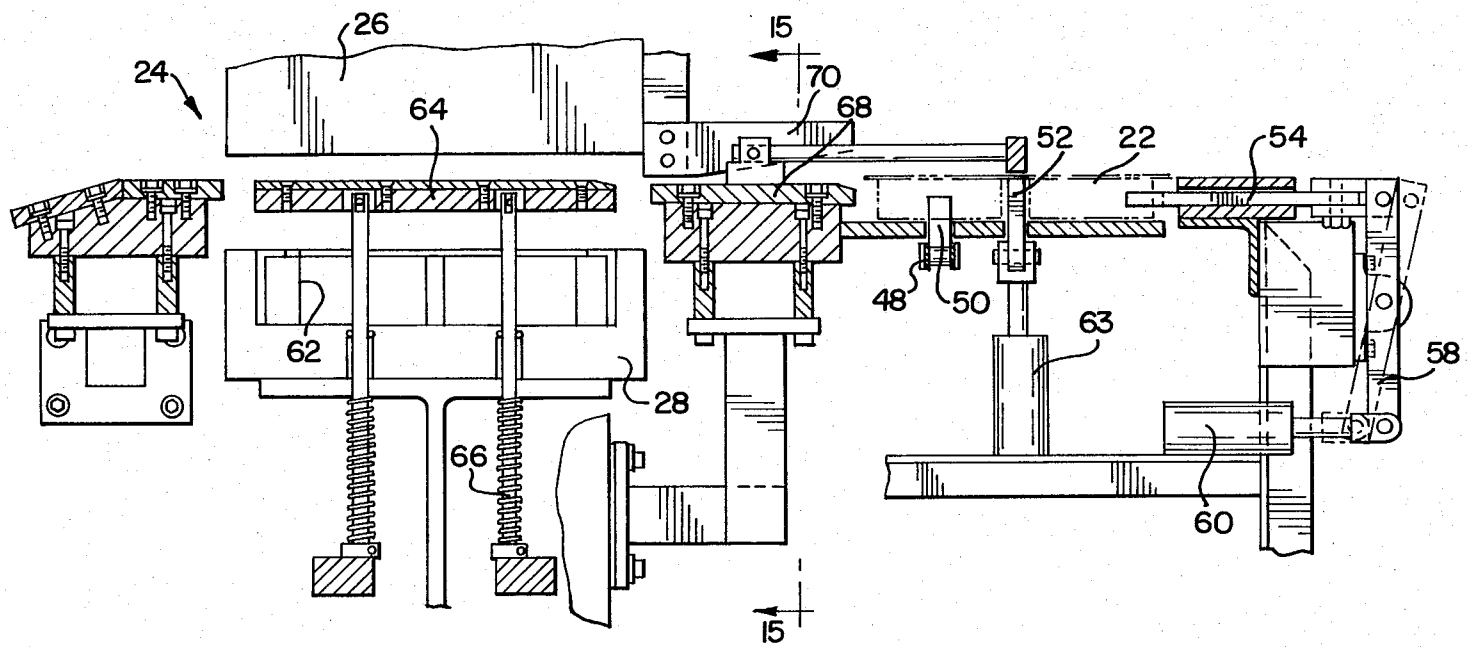

FIG. 14 is a vertical cross-sectional view taken along line 14—14 of FIG. 13.

Figure 15:
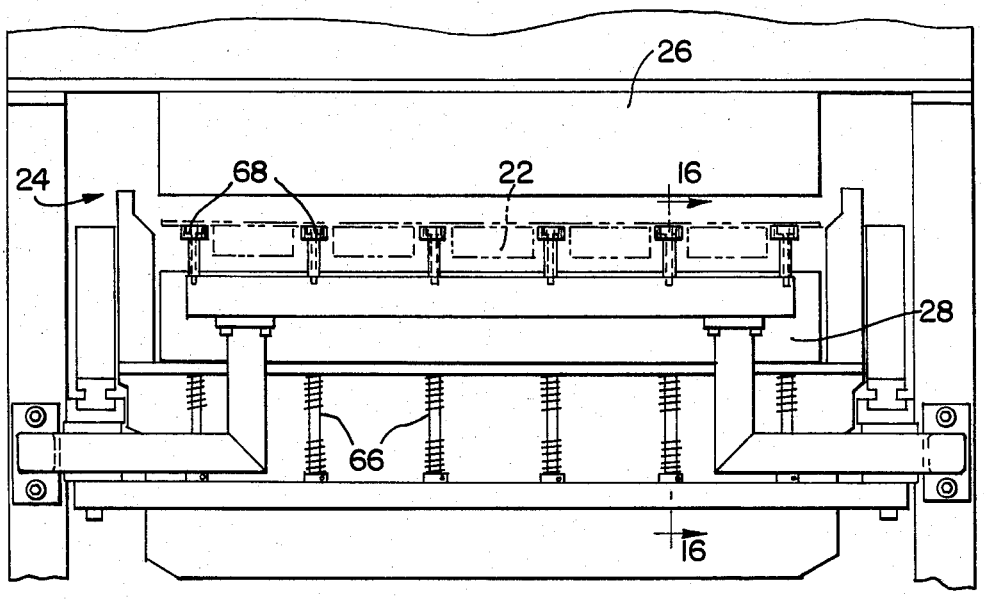

FIG. 15 is a side elevational view of the package-forming machine when the sealing portions are spaced apart, taken along line 15—15 of FIG. 14.

Figure 16:
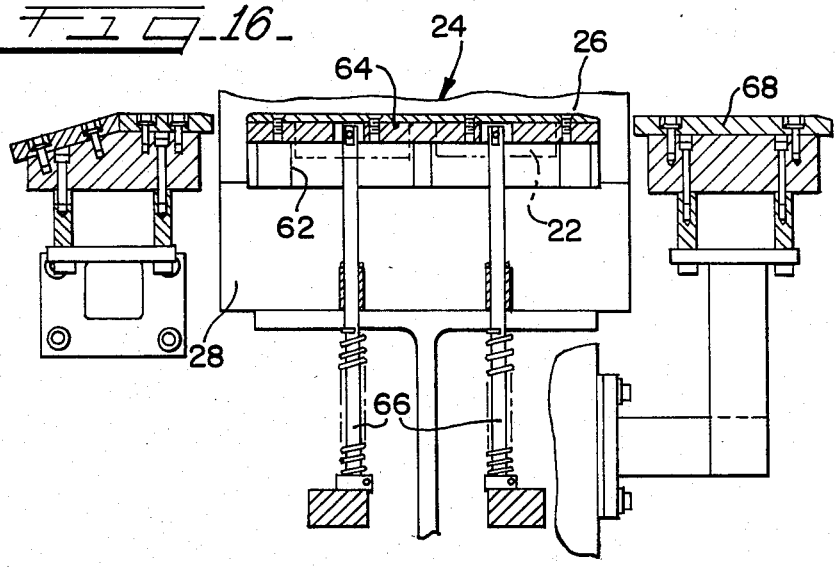

FIG. 16 is a vertical cross sectional view taken along line 16—16 of FIG. 15, but with the sealing portions in a closed, sealing position.

The present invention is embodied in an apparatus, generally at 20 for simultaneously loading and unloading food packages (such as rigid plastic trays 22 of luncheon meat and the like) into and from a package-forming machine 24. The machine 24 has upper and lower portions 26 and 28 which are relatively movable between a spaced-apart position for loading and unloading (depicted in FIG. 1) and a closed sealing position.

In accordance with the present invention, a pusher 30 and puller 32 are mounted on opposite sides of the package-forming machine and are movable toward and away from the package-forming machine 24 to insert and withdraw packages between upper and lower heat-sealing portions. Each pusher and puller includes means to engage the package, preferably in the form of a pair of gripping jaws 34, which are carried by a slidably mounted shuttle 36 for reciprocal movement with respect to the machine 24. Each shuttle is driven to and fro by a rotatably mounted arm 38, which is pivoted toward and away from the machine 24 by one of the rotating drive cranks 40. Control of the opening and closing of the jaws 34 for gripping and releasing the tray 22 is effected during movement of each shuttle by a bellcrank 42 which is attached to the jaws, and which cooperates with a latch 44 which holds the bellcrank in a selected jaw-open or jaw-closed position.

Turning now to a more detailed description, the apparatus 20 is of generally upright configuration and supported for the most part by a transverse I-beam 45. The package-forming machine 24 is mounted below the I-beam, with the upper portion fixed positioned therebeneath and the lower portion movable vertically to open the machine for loading or unloading, as shown in FIG. 1, or to a closed position, in which a vacuum may be drawn and the cover and tray sealed together. In the trade, the upper and lower portions of the package-forming machine are commonly referred to as sealing tubs.

Turning briefly to FIGS. 13–16, FIG. 13 is a horizontal plan view looking down into the inside surface of the lower portion 28 of the package-forming machine 24, and also showing a supply conveyor 46 adjacent the machine which provides a continuous supply of trays 22 which must be sealed. As shown in dashed lines, each tray 22 has two rows of product-containing cavities, with five cavities per row. After sealing and trimming, each cavity will in fact be a separate package. When arriving adjacent to the package-forming machine, the backing or cover, which is approximately the same size as the tray, has already been placed over the tray in a previous operation.

The trays 22 are moved along the supply conveyor to a position adjacent the package-forming machine by an intermittent motion endless chain 48 which has a series of upstanding pushers 50 for pushing against the wall of one or more of the product-containing cavities. An upstanding center guide rail 52 along the conveyor surface extends between the rows of cavities to keep the tray properly aligned as the tray moves along the conveyor.

The chain 48 is timed to stop when a tray 22 has moved into position adjacent to the package-forming machine. Proper alignment of the package with the machine is assured by a pair of alignment plates 54 which are slidably mounted at precise locations along the conveyor. Each plate has a V-shaped front edge for positively engaging against one of the circular meat-containing cavities, thereby correcting any slight misalignment that may have occurred when the conveyor stopped.

The alignment plates 54 are slidably mounted on the edge of the conveyor 46 by a pair of brackets 56. For movement of the alignment plates between a retracted position, where they do not interfere with movement of the tray 22 along the conveyor, and an aligning position, where they engage the package, the plates are connected by pivot link 58 to an air or hydraulic cylinder 60 mounted beneath the conveyor surface (see FIG. 14). Retraction of the air cylinder shaft moves the aligning plates to the retracted position, and extension of the shaft moves the plates to a package aligning position. After the package 22 is aligned, the center guide rail 52 of the conveyor is pulled below the conveyor surface by air cylinder 63 so as to permit sideways movement of the tray by the pusher 30 (not shown in FIGS. 13–16) for insertion into the package-forming machine 24.

As best seen in FIGS. 14 and 16, the lower portion 28 of the machine 24 includes cavities 62 (corresponding to the food-containing portions of the tray 22) for receiving the tray in a generally nesting relationship. For lowering and raising the tray 22, into and out of the cavities, a plurality of lifting rails 64 is provided in the lower sealing portion 28. The rails are mounted on vertical rods 66 and are positioned to slide between adjacent pairs of tray cavities when the tray is inserted into the package-forming machine. In the illustrated embodiment, the rods 66, which extend through the lower sealing portion, are held in a vertical position. When the lower sealing portion is moved up and down to close or open the package-forming machine, the rails effectively permit an unsealed tray to nest within the lower portion or lift a sealed tray from the lower portion depending on the direction of movement of the lower sealing portion.

As best seen in FIG. 14, the lifting rails 64 are in general horizontal alignment with the tray 22 which is to be inserted. When inserted, the tray is pushed across intermediate guide rails 68 which extend between the conveyor and the machine 24 and are level with the lifting rails, so that a simple horizontal sliding movement is all that is needed to insert the tray into the machine 24. A wedge-shaped plate 70 above the intermediate rails act as a keeper to prevent the cover or backing which overlies the tray from lifting out of place during insertion into the package-forming machine.

Figure 4:
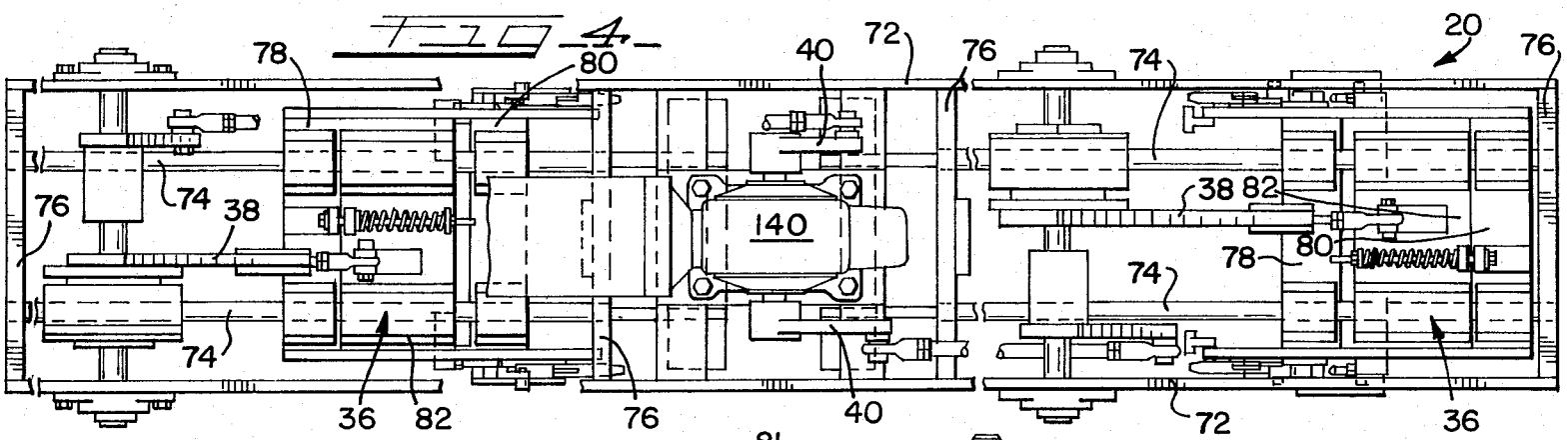
FIG. 4 is a top plan view of the apparatus of FIG. 1.

Returning now to a description of the method and apparatus for inserting unsealed trays and covers into the package-forming machine and withdrawing sealed trays, the I-beam 45 supports a pair of upright parallel side plates 72, one of which is seen in FIG. 1, partially removed, and the other of which is perhaps best seen in FIG. 4. These side plates 72 protect and enclose the drive mechanism for the shuttles 36.

Each of the shuttles 36 is slidably mounted on a pair of cylindrical slide bars 74 which extend horizontally on either side of the machine 24, adjacent the lower edge of the side plates 72. In a side elevational view like that of FIGS. 1–3, only the nearest slide bar is shown. FIGS. 4, 6 and 7 better depict the side-by-side horizontal relationship of each pair of slide bars. The slide bars (generally mounted between end brackets 76 which are secured to the side plates 72) are of polished metallic construction for strength as well as reduced friction with the shuttle. Of course, other materials suitable for this use may also be employed.

The shuttles 36 for both the pusher 30 and puller 32 are substantially identical in construction, and a description of the construction and operation of one will suffice for the other. FIGS. 6 and 7 depict the shuttle 36 for the puller 32. The shuttle has two relatively movable portions. The first movable portion is made up of spaced-apart end plates 78 and 80, which are rigidly connected together by depending slide plates 81. Each of the end plates mounts a pair of slide blocks 79 having bores for slidably receiving the slide bars 74.

The second movable portion of the shuttle 36 is a center plate 82 located between the end plates 78 and 80 and slidably mounted on the slide bars 74 by slide blocks 84. The center plate is narrower than the space between the end plates, thereby leaving clearance for the center plate to slide back and forth a small distance between the end plates. As best seen in FIG. 6, the center plate 82 is biased to a position against the edge of the rear end plate 78 by compressive force of a coil spring 86, which is mounted around bolt 88. The bolt 88 extends through an upright bracket 92 on the center plate and terminates with a spring retaining ring 94. The spring 86 is held in compression between the retaining ring and the bracket on the center plate, thereby biasing the center plate against the leading edge of the rear end plate 78.

For moving the shuttle back and forth, the pivot arm 38 is attached to the shuttle at mounting bracket 96 on the center plate. The relative movement permitted between the center plate 82 and the end plates 78 and 80 of the shuttle operate, as will be discussed more fully later, in conjunction with the bellcrank 42 and latch 44 to control opening and closing of the jaws 34 when the shuttle is moved against the end of its stroke toward the package-forming machine.

In both the pusher 30 and puller 32, a pair of gripping jaws 34 is pivotally attached to each of the depending side plates 81 of the shuttle. Referring to FIGS. 5 and 5*a*, which are examplary of the gripping jaws for both the loading and unloader, center bolt 98 pivotally connects the upper and lower gripping jaws together as well as attaching these jaws to the side plate 81. Opening and closing of the jaws is caused by the reciprocal movement of actuating linkage 100 which is connected at one end to the bellcrank 42, and at the other end to a pair of linkages 102 which are secured to the rearward ends of the jaws.

As best seen in FIG. 5, reciprocal movement of the actuating linkage 100 to the left pulls the connecting linkages 102 to the left, causing the jaws to pivot open about the center bolt 98. Pushing the link in the other direction forces the rearward ends of the jaws apart, closing the front gripping end of the jaws 34 is the result of reciprocal, side-to-side movement of the actuating linkage 100.

FIG. 8 illustrates the shuttle 36 and jaws 34 of the puller 32, in a position wherein the jaws are open, for example, during movement toward the package-forming machine, but before gripping a sealed tray 22 (not shown). In FIG. 8, the shuttle 36 would be moving to the right, by reason of pivoting of the pivot arm 38, which is connected via connecting rod 104 to bracket 96 on the center plate of the shuttle.

To control the opening and closing of the gripping jaws, bellcrank 42 is pivotally mounted by bolt 106 to the vertically depending side plate 81. There is one side plate 81 on each side of the shuttle, so that the puller unit has two pairs of gripping jaws for withdrawing a sealed tray from the package-forming machine. Each side plate mounts the same bellcrank and latch arrangement. The bellcrank 42 has three crank arms, generally at right angles to one another. The downwardly extending crank arm, which is pivotally attached to the end of the actuating linkage 100, is also biased by tension spring 108 to a jaws-closed position. The sidewardly extending crank arm carries a cam follower 110, and the upper arm of the bellcrank carries a pin 112 which cooperates with the latch 44 to hold the bellcrank in a selected position.

The latch 44 for the puller 32 in FIG. 8 is generally L-shaped and is pivotally mounted at 114 to the side plate 81. The horizontal leg of the latch has an undercut 116 for engaging the bellcrank pin 112, and the vertical leg is biased by tension spring 118 for pivoting counterclockwise into the latching position.

In the position depicted in FIG. 8, the latch 44 is in engagement with the pin 112 on the upper arm of the bellcrank, holding the bellcrank in a jaws-open position. In FIG. 8, the puller is being moved to the right, toward a sealed package.

The operation of the jaws 34 when the sealed package 22 is reached is depicted in FIG. 9. At that point, the shuttle 36 has reached an end stop 120 adjacent to the package-forming machine which is engaged by the leading edge of end plate 80 of the shuttle. Although the forward edge of the plate 80 is prevented from moving further by reason of the stop 120, the pivot arm 38 continues forward a small distance, forcing the center plate 80 forward against the biasing force of coil spring 86. This moves a latch engaging pin 122 carried by the center plate against the vertical leg of the latch 44, causing the latch to pivot and release the bellcrank 42. Tension spring 108 then pulls the bellcrank counterclockwise, driving the actuating linkage 100 forward and closing the jaws 34 on the peripheral edge of the tray 22 (not shown). The pivot arm 38 then moves rearwardly, pulling the shuttle 36 away from the package-forming machine, and withdrawing the sealed package 22 from between the upper and lower portions of the machine.

At the rearward end of the withdrawing stroke, a cam surface 124 (FIG. 3) is positioned to engage the cam follower 110 on the bellcrank, forcing the bellcrank downwardly, and pivoting the bellcrank clock to pull the actuating linkage to a jaws-open position. This simultaneously moves the upper arm of the bellcrank back into latching engagement with the latch 44, which holds the jaws open until the end of the next stroke toward the package-forming machine, at which time the above-described operation for closing the jaws is repeated.

Referring to FIGS. 10–12, the construction and operation of the pusher 30 is similar in many respects to that of the puller 32. As with the puller, the jaws 34 of the pusher are pivotally mounted to the depending side plate 81 of the shuttle 36 by bolt 98. The opening and closing action of the jaws is also similar to that of the puller, in that this action is controlled by an actuating linkage 100, which is pivotally attached via connecting linkages 102 to rearward ends of the jaws. With the pusher, however, the jaws include a generally cylindrical guide 126 on the front edge of the lower jaw to aid in guiding the edge of the package into the space between the jaws.

In addition, in the pusher 30, as with the puller 32, the end of the actuating linkage 100 is attached to the lowermost arm of the bellcrank 42 which is pivotally mounted to the side plate 81. In the pusher, the bellcrank also has three arms or cranks, generally at right angles to one another. The sidewardly extending arm carries a cam follower 110, and the upwardly extending arm includes a pin 112, which cooperates with an undercut portion 116 in latch plate 44. As with the puller, coil spring 108 biases the bellcrank to a jaws closed position, and latch coil spring 118 biases the latch to a latching position in which the bellcrank pin 112 is received in the undercut portion forming the latch.

In contrast to the puller, the pusher has an actuator pin 128 which extends from the center plate 82 of the sliding shuttle 36 and is positioned to engage the upwardly extending arm of the bellcrank, instead of the latch as with the puller. Also, the latch 44 of the puller is not L-shaped, but has a cam follower 130 for releasing the latch.

In the position shown in FIG. 10, the pusher is at the fully retracted position, prior to movement toward the package-forming machine for inserting an unsealed package 22. In this position, cam follower 110 of the bellcrank has engaged the upwardly sloped cam surface 132 mounted on the frame of the package-forming machine, causing the bellcrank to pivot counterclockwise, pulling the actuating linkage 100 to the right, thereby opening the jaws. In this position, the upper arm of the bellcrank 42 is engaged with the latch 44.

During operation of the apparatus, pivot arm 38 pulls the slide shuttle to the left until the jaws are adjacent to an unsealed package, which is provided by the supply conveyor 46 (not shown in FIGS. 10 or 11). At that position, cam surface 134 which is mounted on the apparatus frame engages cam follower 130 of the latch 44, pivoting the latch to release the bellcrank, and thereby allowing spring 108 to close the jaws on the peripheral edge of the package 22.

Continued movement of the pusher to the left by the pivot arm inserts the tray into the space between the upper and lower sealing portions 26 and 28 of the package-forming machine. At the end of the insertion stroke, when the package is fully inserted into the space (FIG. 12), the forward edge of the end plate 80 of the shuttle 36 engages against stop 120 which is fixedly mounted on the apparatus frame. However, the pivot arm continues to move a short distance, pulling the center plate 82 forward against the biasing action of the coil spring 86, until the actuating pin 128 engages against the bellcrank 42, causing the bellcrank to pivot counterclockwise, and thereby opening the jaws to release the inserted tray. This action also returns the upper arm of the bellcrank into latch position with the latch 44. After this is complete, the motion of the pivot arm is reversed, and the jaws are withdrawn so that the upper and lower sealing portions can close and the heat-sealing be performed.

Referring back to FIGS. 1 and 3, the pivot arms 38 are driven by an electric motor 138 mounted atop the I-beam 45. The motor 138 is attached to a gear box 140 which turns the pair of drive cranks 40 mounted on opposite sides of the gear box. Each drive crank is attached via connecting rod 142 with an intermediate pivot arm 144. The intermediate pivot arm 144 is pivotally attached to the same shaft 146 as the pivot arm 38, so that turning of the shaft 146 by the intermediate pivot arms also causes movement of the pivot arm 38 which drives the shuttle.

The drive cranks could have been directly connected to the pivot arms 38 rather than through an intermediate pivot arm 144. However, with the present construction, the stroke of the pivot arms 38 which drive the shuttle may be easily adjusted by simply changing the angular position of each pivot arm on shaft 146.

In FIGS. 1 ∝ 3, the drive crank 40 for the pusher 30 is displaced approximately 45° from the crank 40 for the puller 32. Rotation of the cranks is in a clockwise direction, thereby causing the pusher to lead the puller in the reciprocal motion toward and away from the package-forming machine. This provides a position (depicted in FIG. 1) wherein neither the jaws of the puller nor the jaws of the pusher are located between the upper and lower sealing portions, thereby permitting these portions to close and perform the sealing of the package 22.

In an alternative embodiment of this invention, the conveyor 46 does not have center guide rail 52 or alignment plates 54. In this alternative embodiment, the chain 48 would be fitted with T-bars which move the trays 22 into position adjacent to the package-forming machine 24. As the pusher 30 moves forward, the guides 26 contact and push the tray 22 into the intermediate guide rails 68 which align the tray 22 to the cavities 62 in the package-forming machine 24. At this time, the cam surface 134 contacts the cam follower 130 on latch 44 to release the latch. This release allows the bellcrank 42 to rotate and the jaws 34 to close and grip the tray 22 as the tray moves into machine 24.

Although the present invention has been described in terms of a preferred embodiment, this invention can be embodied in various forms and, therefore, is to be construed and limited only the the scope of the appended claims.

I claim:

1. In a package-forming machine having an apparatus for sealing a package cover to a food containing package tray, which apparatus includes a pair of sealing portions which are relatively movable between a spaced-apart position and a closed sealing position, the improvement comprising, in combination:

a pair of shuttles slidably mounted on opposite sides of the sealing portions and movable toward and away from the sealing portions;

each of the shuttles including at least a pair of sliding portions biased to a normally spaced-apart relationship;

a pair of gripping jaws carried by one of the sliding portions of each shuttle;

means for reciprocally moving each of the shuttles toward and away from the sealing portions, said moving means including a drive member attached to another of the sliding portions of each shuttle;

a stop defining the end of the movement of each shuttle toward the sealing portions, the stop being disposed to engage the jaw-carrying sliding portion;

jaw control means carried by the jaw-carrying sliding portion operable to move the gripping jaws of the respective shuttle between open and closed positions; and means associated with said another sliding portion of each shuttle adapted to engage the respective jaw control means when the sliding portions of each shuttle are adjacent at the end of shuttle movement toward the sliding portions.

2. A machine in accordance with claim 1, wherein the jaw control means comprises a bellcrank operatively connected to the jaws to open and close the jaws, and a latch operable to hold the bellcrank in a position corresponding to one of the open and closed jaw positions.

3. A machine in accordance with claim 2, wherein each of the bellcranks comprises three crank arms, a first bellcrank arm being operatively connected to the jaws, a second bellcrank arm including a cam follower attached to the arm, and the third bellcrank arm being adapted for engagement with the latch.

4. A machine in accordance with claim 3, wherein the bellcrank of one shuttle is spring biased to move the jaws of the shuttle to a closed position, and the latch of the shuttle is spring biased to hold the bellcrank in the jaws-open position, the machine further comprising a first cam surface located generally adjacent one end of the one shuttle away from the sealing portions and engageable with the second bellcrank arm to pivot the bellcrank to the jaws-open position, the bellcrank being held in such position by the latch, and a second cam positioned between the first and second sealing portions and positioned to engage the latch to release the bellcrank, permitting the jaws to close, and the means associated with the other of the sliding portions of the one shuttle being disposed to engage the bellcrank when the end stop is engaged, to move the bellcrank to the jaws-open position.

5. A machine in accordance with claim 3, wherein the bellcrank of one of the shuttles is spring biased to move the jaws of the one shuttle to a closed position, and the latch of the one shuttle is spring biased to hold the bellcrank in the jaws-open position, the machine further comprising a cam surface located adjacent the end of movement of the one shuttle away from the sealing portions and engageable with the second bellcrank arm to pivot the bellcrank to the jaws-open position, the bellcrank being held in such position by the latch, and the means associated with the other of the sliding portions of the one shuttle being positioned to engage the latch when the end stop is engaged to release the bellcrank for movement to the jaws-closed position.

6. A machine in accordance with claim 1, wherein the drive member for each shuttle is an arm pivotally mounted at one end and attached to the shuttle at the other end, and the drive means further comprises a rotating crank operatively connected to the arms to pivot the arms simultaneously in opposite directions.

7. A machine in accordance with claim 6, wherein the crank for one of the pivot arms is angularly displaced from the crank of the other arm.

* * * * *

UNITED STATES PATENT AND TRADEMARK OFFICE

CERTIFICATE OF CORRECTION

PATENT NO. : 4,509,311

DATED : 4/9/85

INVENTOR(S) : Carroll P. Hartl

It is certified that error appears in the above-identified patent and that said Letters Patent are hereby corrected as shown below:

On the cover page, the Assignee, delete "General Foods Corporation" and insert -- Oscar Mayer Foods Corporation --.

Signed and Sealed this

*Third* Day of *September 1985*

[SEAL]

*Attest:*

DONALD J. QUIGG

*Attesting Officer* *Acting Commissioner of Patents and Trademarks - Designate*